US012529278B2

(12) United States Patent
AlMilad et al.

(10) Patent No.: US 12,529,278 B2
(45) Date of Patent: Jan. 20, 2026

(54) UNIVERSAL FISHING TOOL AND METHOD OF REMOVING A FISH FROM A WELLBORE

(71) Applicant: Saudi Arabian Oil Company, Dhahran (SA)

(72) Inventors: Rashad I. AlMilad, Qatif (SA); Shaker A. BuHassan, Al-Hofuf (SA); Yousef A. Mubarak, AlHulilah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/644,798

(22) Filed: Apr. 24, 2024

(65) Prior Publication Data

US 2025/0334014 A1 Oct. 30, 2025

(51) Int. Cl.
*E21B 31/00* (2006.01)

(52) U.S. Cl.
CPC ..... *E21B 31/007* (2013.01)

(58) Field of Classification Search
CPC ..... E21B 31/007
See application file for complete search history.

(56) References Cited

U.S. PATENT DOCUMENTS 1,534,229 A * 4/1925 Livergood ..... E21B 31/007 294/86.1
1,567,109 A * 12/1925 Boynton ..... E21B 31/007 294/86.1
2,686,689 A * 8/1954 Herbert ..... E21B 31/007 264/68
2,789,004 A * 4/1957 Foster ..... E21B 31/007 164/DIG. 12
4,515,218 A * 5/1985 Bissonnette ..... E21B 33/16 166/242.8
7,503,388 B2 3/2009 Fay et al.
10,309,187 B2 * 6/2019 Carragher ..... E21B 29/10
11,186,759 B2 11/2021 Kalgaonkar et al.
11,840,901 B2 * 12/2023 Alqahtani ..... E21B 31/007
(Continued)

OTHER PUBLICATIONS

The Engineering ToolBox (2008). Concrete Properties. [online] Available at: https://www.engineeringtoolbox.com/concrete-properties-d_1223.html (Year: 2024).*

(Continued)

*Primary Examiner* — Neel Girish Patel
(74) *Attorney, Agent, or Firm* — DINSMORE & SHOHL LLP

(57) ABSTRACT

A method of removing a fish from a wellbore comprises attaching a fishing tool to a distal end of a conveyor, the fishing tool comprising a housing and a self-solidifying material disposed within a cavity of the housing and configured to transition from a relatively soft state to a relatively hard state; inserting the fishing tool attached to the conveyor into the wellbore; lowering the fishing tool over the fish in the wellbore to immerse at least a portion of the fish within the self-solidifying material; allowing the self-solidifying material to transition from the relatively soft state to the relatively hard state, thereby securing the fish to the fishing tool; and retracting the fishing tool attached to the conveyor from the wellbore to remove the fish from the wellbore.

19 Claims, 4 Drawing Sheets

(56) References Cited

U.S. PATENT DOCUMENTS

| | | | | |
|---|---|---|---|---|
| 2003/0024708 | A1* | 2/2003 | Ring | E21B 43/14 166/207 |
| 2011/0132606 | A1* | 6/2011 | Demong | E21B 33/13 166/293 |
| 2014/0008067 | A1* | 1/2014 | Roddy | C09K 8/426 166/305.1 |
| 2020/0284109 | A1* | 9/2020 | Cook | E21B 43/267 |
| 2021/0270103 | A1* | 9/2021 | Greci | E21B 31/18 |
| 2022/0389302 | A1* | 12/2022 | Welch | C09K 8/426 |
| 2024/0344420 | A1* | 10/2024 | Cedola | C04B 28/006 |

OTHER PUBLICATIONS

American Petroleum Institute (API), "Cements and Mterials for Well Cementing", API Specification 10A, Twenty-Fifth Edition, Mar. 2019 (74 pages).

Wang et al., "Resin Squeeze Operation to Successfully Seal Micro-Channels and Eliminate Sustained Casing Pressure of a Sour Gas Well", Society of Petroleum Engineers, IADC/SPE-201008-MS, Jun. 4, 2021.

Ying et al., "Study of Gel Plug for Temporary Blocking and Well-Killing Technology in Low-Pressure, Leakage-Prone Gas Well", Society of Petroleum Engineers, SPE Production & Operations, pp. 234-244, Feb. 2021.

* cited by examiner

UNIVERSAL FISHING TOOL AND METHOD OF REMOVING A FISH FROM A WELLBORE

TECHNICAL FIELD

The present disclosure generally relates to fishing tools and methods for the recovery of objects from wellbores.

BACKGROUND

In the oil and gas industry, hydrocarbon fluids are commonly extracted from hydrocarbon reservoirs. These hydrocarbon reservoirs are often located far below the surface of the earth in porous rock formations. In order to access the hydrocarbon fluids, wells are drilled into the formations. In the course of drilling and completing wellbores to produce oil and gas from subterranean reservoirs, or while stimulating and producing hydrocarbons from subterranean reservoirs, it is not uncommon for objects to be unintentionally dropped into the wellbore from the surface or for downhole tools and equipment to become separated from their conveyor. When this occurs, it is frequently necessary to retrieve the dropped object or separated downhole tools from the wellbore before normal drilling, completing, stimulating, or producing operations may continue. In the petroleum engineering context, this process of retrieval is commonly called "fishing," and the equipment or tools to be retrieved are commonly called "fish." For the safety, integrity, and accessibility of the wellbore for future well intervention jobs, engineers conduct fishing operations to retrieve the dropped object or separated downhole tools with the help of fishing tools.

SUMMARY

Conventional fishing tools are designed to catch fish having a particular size, shape, and orientation in the wellbore. For example, fishing tools having an overshot grapple are configured to be fixedly attached to the fish by surrounding the fish and gripping it from the outside, and thus must be sized such that internal grapple elements of the overshot grapple may properly engage and secure the fish to the fishing tool. Other types of existing fishing tools use different mechanisms to secure the fish to the fishing tool, but are still typically selected in view of the characteristics of the fish to be retrieved. That is, the proper selection of conventional fishing tools and the success of said fishing tools in a particular fishing operation requires the operators conducting the fishing operation to be informed as to characteristics of the fish to be retrieved as well as its condition (e.g., orientation) in the wellbore. Moreover, conventional fishing tools are designed to retrieve fish having particular neck profiles such as, for example, the profile of a disconnected portion of a drill string. As such, conventional fishing tools are often limited in their ability to latch on to fish having non-standard or damaged neck profiles.

Accordingly, a need exists for a fishing tool and method that allows the fishing tool to latch onto fish having non-standard neck profiles and/or fish that are awkwardly positioned and/or awkwardly oriented in the wellbore. The present disclosure addresses this need by providing a universal fishing tool and method of removing fish from a wellbore. In particular, the fishing tools and methods of the present disclosure incorporate a self-solidifying material within the fishing tool that is configured to stiffen after a fish is immersed therein, thereby securing the fish to the fishing tool. In this manner, fish having non-standard or damaged neck profiles, or fish that have standard neck profiles but are awkwardly positioned or oriented in the wellbore, can nevertheless be secured to the fishing tool provided the fishing tool may be lowered over the fish such that at least a portion of the fish becomes immersed within the self-solidifying material housed by the fishing tool. That is, the fishing tools and methods of the present disclosure may be used to retreive fish that conventional fishing tools struggle to latch onto. Accordingly, the fishing tools and methods of the present disclosure may be used to enhance the efficiency of fishing operations, promote well accessibility, and improve overall operational success while minimizing downtime and operational disruptions.

According to a first aspect of the present disclosure, a method of removing a fish from a wellbore comprises attaching a fishing tool to a distal end of a conveyor, the fishing tool comprising a housing and a self-solidifying material disposed within a cavity of the housing and configured to transition from a relatively soft state to a relatively hard state. The housing comprises a proximal end configured to be attached to the distal end of the conveyor and a distal end opposite The method of the first aspect further comprises: inserting the fishing tool attached to the conveyor into the wellbore; lowering the fishing tool over the fish in the wellbore to immerse at least a portion of the fish within the self-solidifying material; allowing the self-solidifying material to transition from the relatively soft state to the relatively hard state, thereby securing the fish to the fishing tool; and retracting the fishing tool attached to the conveyor from the wellbore to remove the fish from the wellbore.

A second aspect includes the first aspect, wherein attaching the fishing tool to the distal end of the conveyor comprises: attaching a bottom hole assembly to the distal end of the conveyor; and attaching the fishing tool to a distal end of the bottom hole assembly.

A third aspect includes one of the first or second aspects, wherein the fishing tool further comprises a connector coupled to the proximal end of the housing, and wherein attaching the fishing tool to the distal end of the conveyor comprises attaching the connector to the distal end of the conveyor.

A fourth aspect includes any one of the first through third aspects, wherein the self-solidifying material fills the cavity of the housing between a first depth $d_1$ and a second depth $d_2$, wherein the second depth $d_2$ is more proximal than the first depth $d_1$.

A fifth aspect includes the fourth aspect, wherein the fishing tool further comprises a plurality of pins traversing the cavity of the housing at an intermediate depth $d_3$, wherein the intermediate depth $d_3$ is more proximal than the first depth $d_1$ but more distal than the second depth $d_2$, and wherein the plurality of pins are configured to secure the self-solidifying material within the cavity of the housing.

A sixth aspect includes the fourth aspect, wherein the fishing tool further comprises a plurality of spikes configured to secure the self-solidifying material within the cavity of the housing.

A seventh aspect includes the sixth aspect, wherein the housing further comprises: a central axis CA; an end wall positioned at the proximal end of the housing; and a sidewall extending coaxially with the central axis CA from a perimeter of the end wall to a distal end plane of the housing. Each spike of the plurality of spikes: extends inward from an interior surface of the sidewall at an intermediate depth $d_3$ more proximal than the first depth $d_1$ but more distal than the second depth $d_2$; and forms an angle $\alpha$ with respect to the sidewall, the angle $\alpha$ being greater than or equal to 10 degrees and less than or equal to 90 degrees.

An eighth aspect includes the sixth aspect, wherein the housing further comprises: a central axis CA; an end wall positioned at the proximal end of the housing; and a sidewall extending coaxially with the central axis CA from a perimeter of the end wall to a distal end plane of the housing, and wherein the plurality of spikes comprises a first set of spikes and a second set of spikes. Each spike of the first set of spikes: extends inward from an interior surface of the sidewall at a first intermediate depth $d_3$ more proximal than the first depth $d_1$ but more distal than the second depth $d_2$; and forms an angle $\alpha$ with respect to the sidewall, the angle $\alpha$ being less than 90 degrees. Each spike of the second set of spikes: extends inward from the interior surface of the sidewall at a second intermediate depth $d_4$ more proximal than the first depth $d_1$ but more distal than the first intermediate depth $d_3$; and forms the angle $\alpha$ with respect to the sidewall.

A ninth aspect of the present disclosure includes the fourth aspect, wherein: the housing further comprises: a central axis CA; an end wall positioned at the proximal end of the housing; and a sidewall extending coaxially with the central axis CA from a perimeter of the end wall to a distal end plane of the housing; the cavity of the housing is defined by an interior surface of the end wall, an interior surface of the sidewall, and the distal end plane of the housing; the cavity comprises: an internal diameter ID; and a depth D defined as the distance along the central axis CA between the interior surface of the end wall and the distal end plane of the housing; and the internal diameter ID, the depth D of the cavity, the first depth $d_1$, and the second depth $d_2$ are selected such the immersion of the at least the portion of the fish within the self-solidifying material does not cause displacement of the self-solidifying material out of the cavity of the housing.

A tenth aspect includes any one of the first through ninth aspects, wherein the self-solidifying material comprises a cement.

An eleventh aspect includes any one of the first through ninth aspects, wherein the self-solidifying material comprises a nano-silica based material.

A twelfth aspect includes any one of the first through ninth aspects, wherein the self-solidifying material comprises a time and/or temperature activated gel or foam.

A thirteenth aspect includes any one of the first through ninth aspects, wherein the self-solidifying material comprises a polymerizable resin.

A fourteenth aspect includes any one of the first through thirteenth aspects, wherein the self-solidifying material has a setting time greater than or equal to 2 hours and less than or equal to 12 hours.

A fifteenth aspect includes any one of the first through fourteenth aspects, wherein the self-solidifying material, in the relatively soft state, has a viscosity greater than or equal to one centipoise (cP) and less than or equal to 500,000 cP.

A sixteenth aspect includes any one of the first through fifteenth aspects, wherein the self-solidifying material, in the relatively hard state, has a tensile strength of greater than or equal to one megapascal (MPa) and less than or equal to 2,900 MPa.

A seventeenth aspect includes any one of the first through sixteenth aspects, wherein the self-solidifying material is disposed within an insert that is secured within the cavity of the housing.

An eighteenth aspect includes any one of the first through seventeenth aspects, wherein the fishing tool further comprises a thin film support layer configured to maintain the self-solidifying material within the cavity of the housing.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
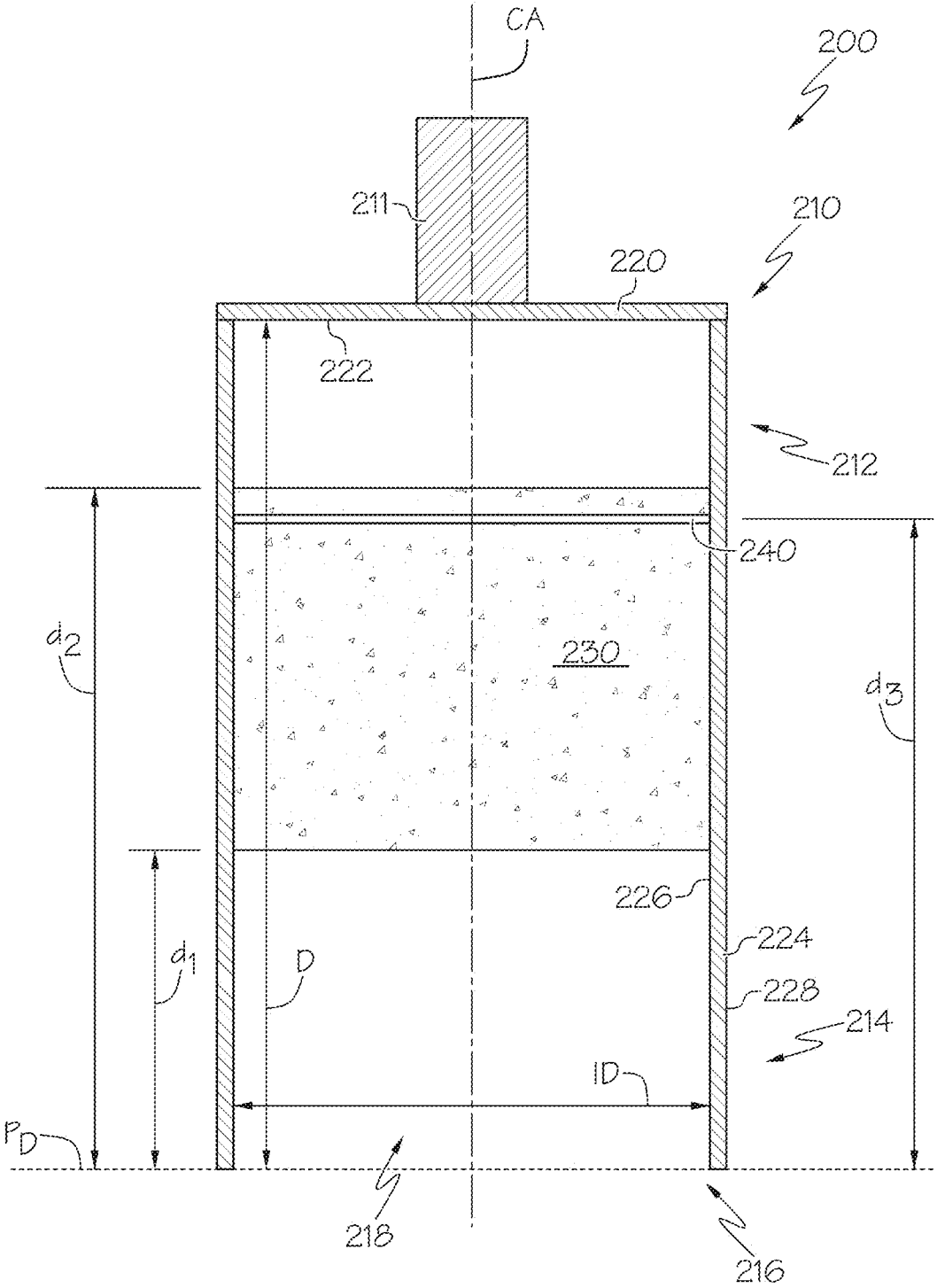
FIG. 1 schematically depicts in cross-section a fishing tool having a self-solidifying material disposed within the cavity of the housing of the fishing tool, according to one or more embodiments described herein.

Reference will now be made to fishing tools of the present disclosure and fishing methods using the same.

As used herein, the terms "downhole" and "uphole" may refer to a position within a wellbore relative to the surface, with uphole indicating a direction or position closer to the surface and downhole referring to a direction or position farther away from the surface. Similarly, as used herein, the terms "downward" and "upward" may refer to a position within a subterranean environment relative to the surface, with upward indicating a direction or position closer to the surface and downward referring to a direction or position farther away from the surface.

As used herein, "wellbore" may refer to a drilled hole or borehole extending down into the ground from the surface of the Earth, and may be an openhole or unlined portion. The wellbore may form a pathway capable of permitting fluids to traverse between the surface and a subterranean reservoir. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment at the surface and the interior of the wellbore. While the present disclosure is primarily focused on wellbores in the oil and gas context, it should be understood that the fishing tools, methods, and systems described herein could also be implemented in other well types, such as water wells.

As used herein, "self-solidifying material" refers to a material that transitions from a relatively soft state to a relatively hard state without the application of an external stimulus. However, it should be understood that the self-solidifying materials described herein may be used in combination with chemical additives and/or other external stimuli (e.g., heat) that influence the transition from the relatively soft state to the relatively hard state.

A method of removing a fish from a wellbore, in accordance with an embodiment of the present disclosure, is now described in detail. The method begins with attaching a fishing tool to a distal end (i.e., furthest downhole end) of a conveyor. The fishing tool comprises a housing having a proximal end configured to be attached to the distal end of the conveyor, and a distal end opposite the proximal end, the distal end comprising an opening that extends into a cavity of the housing. The fishing tool further comprises a self-solidifying material disposed within the cavity of the housing and configured to transition from a relatively soft state to a relatively hard state. The method next involves inserting the fishing tool attached to the conveyor into a wellbore and lowering the fishing tool over a fish in the wellbore to immerse at least a portion of the fish within the self-solidifying material. The method next involves allowing the self-solidifying material to transition from the relatively soft state to the relatively hard state, thereby securing the fish to the fishing tool. Finally, the method then involves retracting the fishing tool attached to the conveyor from the wellbore to remove the fish from the wellbore.

Embodiments of fishing tools of the present disclosure that may be used with the methods described herein for removing a fish from a wellbore are now described in detail with reference to FIGS. 1-4.

FIG. 1 schematically depicts in cross-section a fishing tool 200 in accordance with an embodiment of the present disclosure. The fishing tool 200 shown in FIG. 1 comprises a housing 210 having a proximal end 212 configured to be attached to the distal end of a conveyor (not shown in FIG. 1), and a distal end 214 opposite the proximal end 212, the distal end 214 comprising an opening 216 that extends into a cavity 218 of the housing 210. In the embodiments shown in FIGS. 1-4, the fishing tool 200 is shown comprising a connector 211 coupled to the proximal end 212 of the housing 210 and configured to be attached to the distal end of the conveyor 400 (shown in FIG. 4).

In embodiments, the housing 210 comprises a central axis CA, an end wall 220 positioned at the proximal end 212 of the housing 210 and having an interior surface 222, and a sidewall 224 extending coaxially with the central axis CA from a perimeter of the end wall 220 to a distal end plane $P_D$ of the housing 210, the sidewall 224 having an interior surface 226 and an exterior surface 228. The cavity 218 of the housing 210 may be defined by the interior surface 222 of the end wall 220, the interior surface 226 of the sidewall 224, and the distal end plane $P_D$ of the housing 210. The cavity 218 comprises an internal diameter ID and a depth D, which, in embodiments, is the distance along the central axis CA between the interior surface 222 of the end wall 220 and the distal end plane $P_D$ of the housing 210. The cross-sectional profile of the housing 210 with respect to the central axis CA may be any suitable shape provided the opening 216 is sufficiently sized for a fish to enter the cavity 218 and become at least partially immersed in the self-solidifying material. For example and without limitation, the interior surface 226 and exterior surface 228 of the sidewall 224 may be, in cross-section along the central axis CA, concentric circles (cylindrical housing), concentric squares (square tubing housing), or concentric rectangles (rectangular tubing housing).

Referring still to FIG. 1, a self-solidifying material 230 is disposed within the cavity 218 of the housing 210 and is configured to transition from a relatively soft state to a relatively hard state. In embodiments, the self-solidifying material 230 fills the cavity 218 of the housing 210 between a first depth $d_1$ and a second depth $d_2$, wherein the second depth $d_2$ is more proximal than the first depth $d_1$. As shown in FIG. 1, the first depth $d_1$ may be defined as the distance along the central axis CA between the distal end plane $P_D$ and the most proximal point in the cavity 218 in which the self-solidifying material 230 is provided. The second depth $d_2$ may be defined as the distance along the central axis CA between the distal end plane $P_D$ and the most distal point in the cavity 218 in which the self-solidifying material 230 is provided.

In order to increase the likelihood of a successful fishing operation, it may be necessary to prevent the self-solidifying material 230 from exiting the cavity 218 of the fishing tool 200 upon immersion of the fish into the self-solidifying material 230, as the presence of the self-solidifying material 230 outside of the cavity 218 may restrict removal of the fish and/or the fishing tool 200 from the wellbore due to size restrictions associated with tubing, well casing strings, or the wellhead. Therefore, in embodiments, the first depth $d_1$, the second depth $d_2$, and the relationship therebetween (i.e., the thickness of the self-solidifying material 230 in the cavity 218) may be designed such that immersion of the fish into the self-solidifying material 230 does not cause the self-solidifying material 230 to exit the cavity 218. More specifically, the first depth $d_1$, the second depth $d_2$, and the relationship therebetween may be designed in view of the size of the housing 210 and the characteristics of the fish to be retrieved from the wellbore, e.g., the size of the fish, the weight of the fish, the shape of the fish, the orientation of the fish, etc., such that immersion of the fish into the self-solidifying material 230 does not cause the self-solidifying material 230 to exit the cavity 218.

In embodiments, the fishing tool 200 may comprise internal securing features within the cavity 218 that function to secure the self-solidifying material 230 within the housing 210 of the fishing tool 200. For example, the embodiment of the fishing tool 200 shown in FIG. 1 includes a plurality of pins 240 traversing the cavity 218 of the housing 210 at an intermediate depth $d_3$, wherein the intermediate depth $d_3$ is more proximal (i.e., closer to the proximal end 212 of the housing 210) than the first depth $d_1$ but more distal (i.e., closer to the distal end 214 of the housing 210) than the second depth $d_2$, and wherein the plurality of pins 240 is configured to secure the self-solidifying material 230 within the cavity 218 of the housing 210. The intermediate depth $d_3$ may be selected in view of the amount of support needed to secure the self-solidifying material 230 within the housing 210 of the fishing tool 200, both when the self-solidifying material 230 is in the relatively soft state and after the self-solidifying material has solidified securing the fish therein, as well as when fishing tool 100 is retracted from the wellbore carrying the weight of the fish. The placement of the plurality of pins 240, the number and arrangement of pins, and their characteristics (i.e., material type, diameter, etc.) may further be selected in view of the anticipated weight of the fish to be lifted from the wellbore. Moreover, in embodiments, the plurality of pins 240 may be provided at multiple depths within the cavity 218 of the housing 210.

Figure 2:
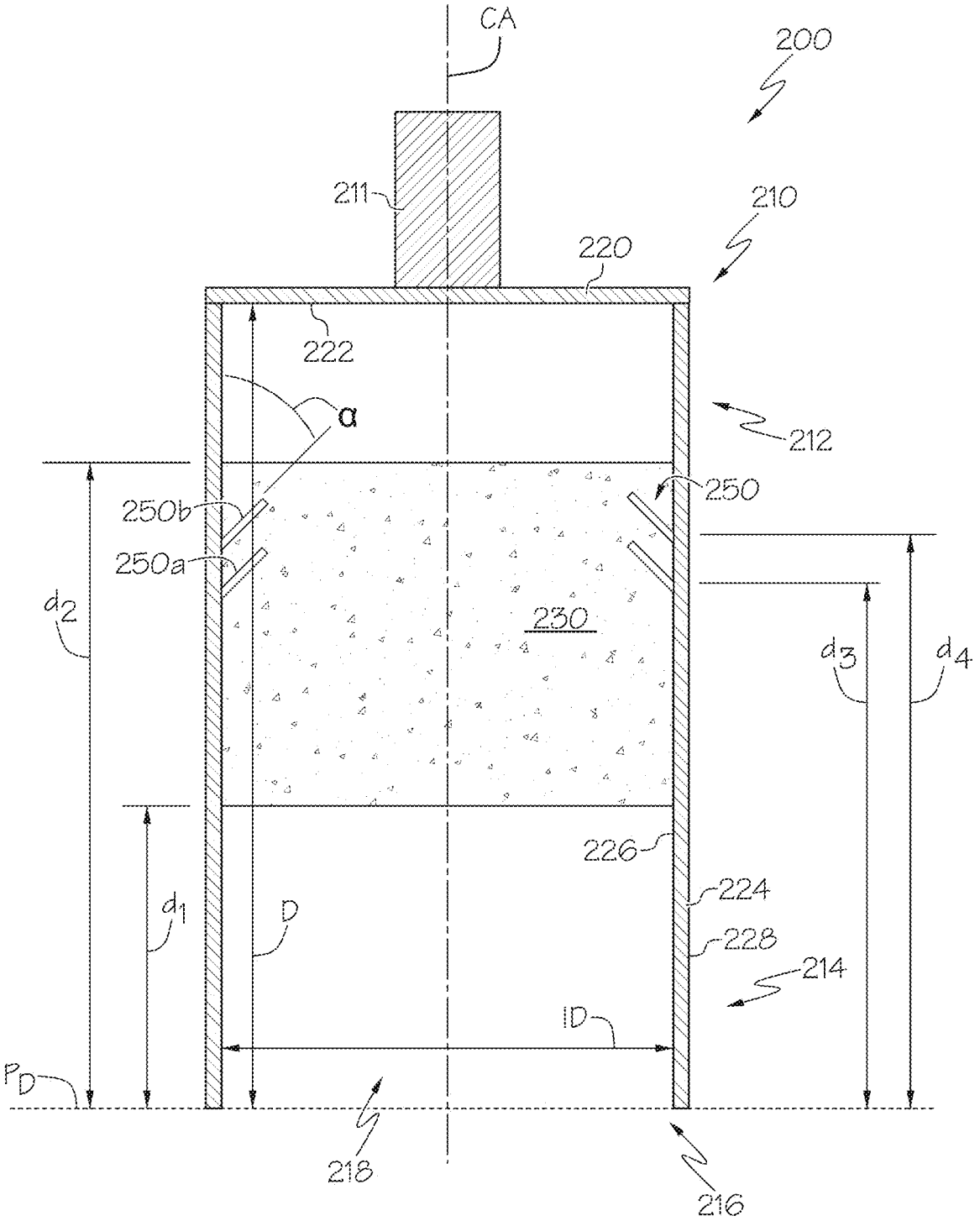
FIG. 2 schematically depicts in cross-section a fishing tool wherein spikes are provided in the cavity of the housing to secure the self-solidifying material therein, according to one or more embodiments described herein.

With reference now to FIG. 2, the fishing tool 200 may alternatively or in addition to the plurality of pins 240, comprise a plurality of spikes 250 configured to secure the self-solidifying material 230 within the cavity 218 of the housing 210. In the embodiment shown in FIG. 2, each spike of the plurality of spikes 250 extends from the interior surface 226 of the sidewall 224 at an intermediate depth $d_3$ more proximal than the first depth $d_1$ but more distal than the second depth $d_2$. Moreover, in the embodiment shown in FIG. 2, each of the plurality of spikes 250 extends upward (i.e., toward the proximal end 212 of the housing 210) such as to form an angle $\alpha$ with respect to the sidewall 224 greater than or equal to 10 degrees and less than or equal to 90 degrees, greater than or equal to 20 degrees and less than or equal to 80 degrees, greater than or equal to 20 degrees and less than or equal to 70 degrees, greater than or equal to 30 degrees and less than or equal to 70 degrees, greater than or equal to 30 degrees and less than or equal to 60 degrees, or greater than or equal to 40 degrees and less than or equal to 50 degrees. In embodiments, the angle $\alpha$ formed between the each of the plurality of spikes 250 and the sidewall 224 may be about 45 degrees.

In embodiments comprising the plurality of spikes 250, the fishing tool 200 may comprise single set of spikes at one depth within the cavity, e.g., intermediate depth $d_3$, or multiple sets of spikes at different depths within the cavity 218, e.g., a first set of spikes 250*a* extending from the interior surface 226 of the sidewall 224 at the first intermediate depth $d_3$ and a second set of spikes 250*b* extending from the interior surface 226 of the sidewall 224 at a second intermediate depth $d_4$, as shown for the embodiment in FIG. 2. In embodiments wherein the plurality of spikes 250 comprises the first set of spikes 250*a* and the second set of spikes 250*b*, the angle formed between each spike of the first set of spikes 250*a* and each spike of the second set of spikes 250*b* may be the same or different.

The first intermediate depth $d_3$ and second intermediate depth $d_4$ of the first set of spikes 250*a* and the second set of spikes 250*b*, respectively, may be selected in view of the amount of support needed to secure the self-solidifying material 230 within the housing 210 of the fishing tool 200, both when the self-solidifying material 230 is in the relatively soft state and after the self-solidifying material has solidified securing the fish therein, as well as when the fishing tool 100 is retracted from the wellbore carrying the weight of the fish. The location and spacing of the first and second set of spikes 250*a*, 250*b* may be designed based on the specifics of a particular fishing operation, i.e., the characteristics of the wellbore and the fish to be retrieved. In embodiments, the placement of the plurality of spikes 250 (e.g., first and second intermediate depths $d_3$, $d_4$), the number and arrangement of spikes, and their characteristics (i.e., material type, diameter, length, etc.) may be selected in view of the anticipated weight of the fish to be lifted from the wellbore.

In embodiments, the self-solidifying material is a cement, such as, for example, a cement selected from the cement formulations described in American Petroleum Institute (API) SPEC 10A standard, incorporated by reference in this disclosure in its entirety. In embodiments, the self-solidifying material is a nano-silica based material, such as, for example, the nano-silica based material described in U.S. Pat. No. 11,186,759, entitled "Chemical plugs for preventing wellbore treatment fluid losses," incorporated by reference in this disclosure in its entirety. In embodiments, the self-solidifying material is a time and/or temperature activated gel or foam, such as, for example, the gel plug described in "Study of Gel Plug for Temporary Blocking and Well-Killing Technology in Low-Pressure, Leakage-Prone Gas Well," SPE 204213-PA, by Xiong Ying et al., SPE Productions & Operations, 36 (01), 234-244, February 2021, incorporated by reference in this disclosure in its entirety. In embodiments, the self-solidifying material comprises a polymerizable resin, such as, for example, the polymerizable resin described in "Resin Squeeze Operation to Successfully Seal Micro-Channels and Eliminate Sustained Casing Pressure of a Sour Gas Well," SPE 201008-MS, by Ying Wang et al., presented at IADC/SPE Asia Pacific Drilling Technology Conference, Virtual, Jun. 4, 2021, incorporated by reference in this disclosure in its entirety.

The transition of the self-solidifying material from the relatively soft state to the relatively hard state may be influenced by time and/or temperature. Further, the self-solidifying material may comprise or be used in combination with additives that control the rate of solidification and/or influence the resulting hardness of the self-solidifying material after it has transitioned to the relatively hard state. The length of time in which it takes the self-solidifying material to transition from the relatively soft state to the relatively hard state, also referred to herein as the "setting time," may be designed considering the time required to rig up the tool and run in hole to the depth of the fish. Depending on the rig up type, fish depth, and characteristics of the wellbore, this may add a minimum of 2 to 4 hours to the required setting time. Moreover, the self-solidifying material may be designed to solidify within 6 hours from the immersion of the fish in the self-solidifying material. Accordingly, in embodiments, the setting time of the self-solidifying material may be greater than or equal to 2 hours and less than or equal to 12 hours, greater than or equal to 2 hours and less than or equal to 10 hours, greater than or equal to 2 hours and less than or equal to 8 hours, greater than or equal to 2 hours and less than or equal to 6 hours, or greater than or equal to 2 hours and less than or equal to 4 hours. In embodiments, the setting time of the self-solidifying material may be greater than or equal to 4 hours and less than or equal to 12 hours, greater than or equal to 4 hours and less than or equal to 10 hours, greater than or equal to 4 hours and less than or equal to 8 hours, or greater than or equal to 4 hours and less than or equal to 6 hours. Moreover, a fish that is far downhole in a wellbore may be retrieved with the fishing tools and methods described herein implementing a self-solidifying material having a relatively long setting time, e.g., greater than or equal to 10 hours. Conversely, a fish that is more uphole in a wellbore may be retrieved with the fishing tools and methods described herein implementing a self-solidifying material having a relatively short setting time, e.g., less than or equal to 2 hours.

In embodiments, the self-solidifying material, in the relatively soft state, has a viscosity greater than or equal to one centipoise (cP) and less than or equal to 500,000 cP, greater than or equal to 100 cP and less than or equal to 500,000 cP, greater than or equal to 1,000 cP and less than or equal to 500,000 cP, greater than or equal to 10,000 cP and less than or equal to 500,000 cP, greater than or equal to 50,000 cP and less than or equal to 500,000 cP, or greater than or equal to 100,000 cP and less than or equal to 500,000 cP, measured in accordance with ASTM standards known in the art, such as ASTM C1874-20, entitled "Standard Test Method for Measuring Rheological Properties of Cementitious Materials Using Coaxial Rotational Rheometer," the contents of which are incorporated herein by reference in their entirety. In embodiments, the self-solidifying material, in the relatively soft state, has a viscosity greater than or equal to one cP and less than or equal to 100,000 cP, greater than or equal to one cP and less than or equal to 50,000 cP, greater than or equal to one cP and less than or equal to 10,000 cP, greater than or equal to one cP and less than or equal to 5,000 cP, greater than or equal to one cP and less than or equal to 1,000 cP, or greater than or equal to one cP and less than or equal to 500 cP, measured in accordance with ASTM standards known in the art, such as ASTM C1874-20.

In embodiments, the self-solidifying material, in the relatively hard state, has a tensile strength of greater than or equal to one megapascal (MPa) and less than or equal to 2,900 MPa, greater than or equal to 10 MPa and less than or equal to 2,900 MPa, greater than or equal to 100 MPa and less than or equal to 2,900 MPa, greater than or equal to 400 MPa and less than or equal to 2,900 MPa, greater than or equal to 800 MPa and less than or equal to 2,900 MPa, greater than or equal to 1,200 MPa and less than or equal to 2,900 MPa, greater than or equal to 1,600 MPa and less than or equal to 2,900 MPa, or greater than or equal to 2000 MPa and less than or equal to 2,900 MPa, measured in accordance with ASTM standards known in the art, such as ASTM D638-14, entitled "Standard Test Method for Tensile Properties of Plastics," the contents of which are incorporated herein by reference in their entirety. In embodiments, the self-solidifying material, in the relatively hard state, has a tensile strength of greater than or equal to one MPa and less than or equal to 2,900 MPa, greater than or equal to one MPa and less than or equal to 2,000 MPa, greater than or equal to one MPa and less than or equal to 1,600 MPa, greater than or equal to one MPa and less than or equal to 1,200 MPa, greater than or equal to one MPa and less than or equal to 800 MPa, greater than or equal to one MPa and less than or equal to 400 MPa, greater than or equal to one MPa and less than or equal to 200 MPa, or greater than or equal to one MPa and less than or equal to 100 MPa, measured in accordance with ASTM standards known in the art, such as ASTM D638-14.

Figure 3:
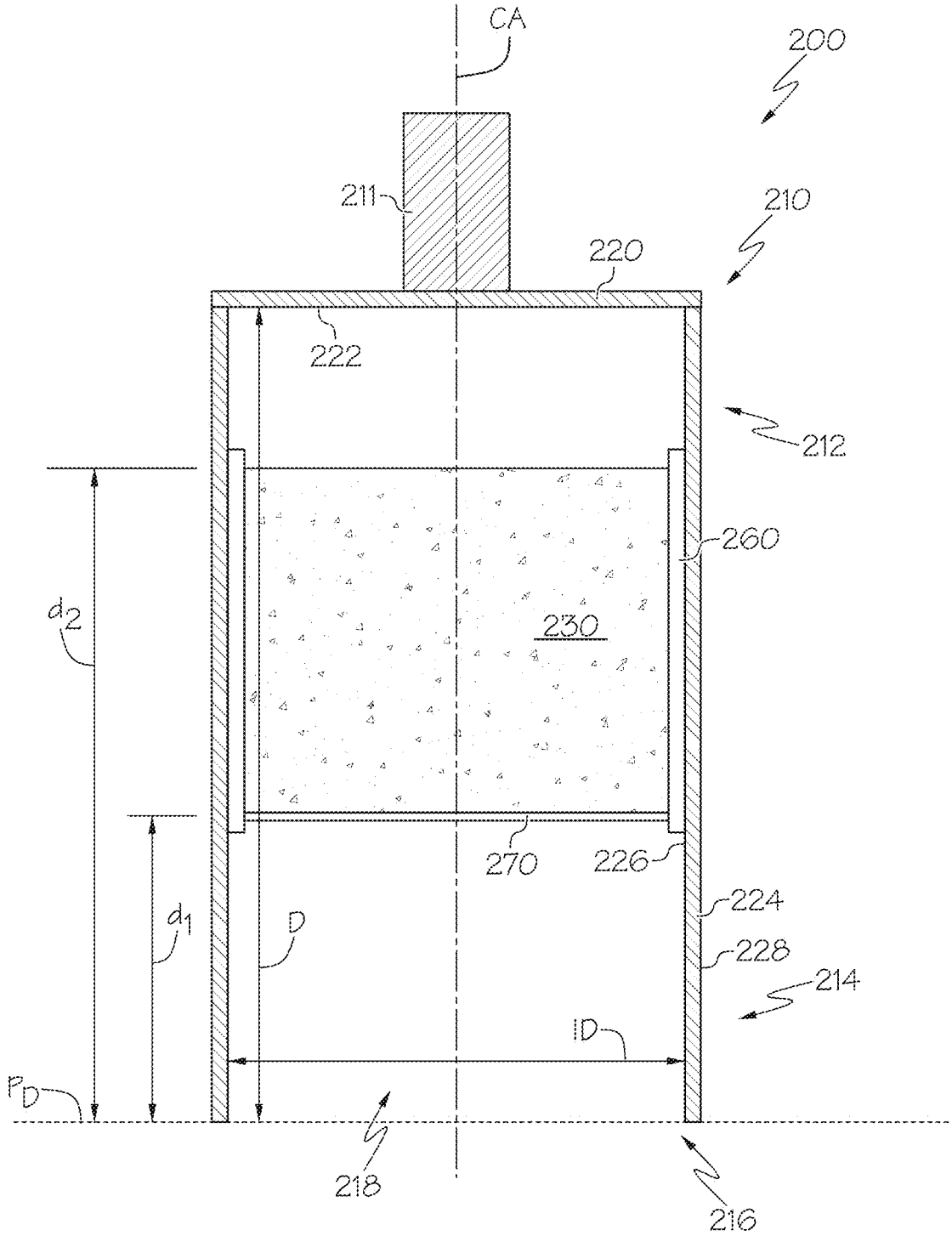
FIG. 3 schematically depicts in cross-section a fishing a fishing tool wherein the self-solidifying material is disposed within an insert that is secured within the cavity of the housing, according to one or more embodiments described herein.

With reference now to FIG. 3, in embodiments, the self-solidifying material 230 may be disposed within an insert 260 that is secured within the cavity 218 of the housing 210. The insert 260 may comprise an open-ended structure, as shown in FIG. 3, or may have one open end and one closed end. In embodiments, the insert 260 may be secured within the cavity 218 of the housing 210 via a welded connection to the housing 210, an adhesive connection to the housing 210, or a mechanical connection to the housing 210. In embodiments, the mechanical connection between the insert 260 and the housing 210 may comprise a threaded connection, e.g., with an externally threaded insert 260 and an internally threaded housing 210 (e.g., threads on the interior surface 226 of the sidewall 224), pin and hole connection(s), or by engagement between a protrusion on the insert 260 and a groove on interior surface 226 of the sidewall 224 (or vice versa).

Also depicted in the embodiment shown in FIG. 3 is a thin film support layer 270 that is configured to maintain the self-solidifying material 230 within the cavity 218 of the housing 210. The thin film support layer 270 may comprise the same base material as the self-solidifying material 230 but be provided in a more rigid initial state than the remaining portion of the self-solidifying material 230. That is, the thin film support layer 270 may have an intermediate stiffness that is more stiff than the self-solidifying material 230 in the relatively soft state but less stiff than the self-solidifying material 230 in the relatively hard state. In embodiments, the thin film support layer may comprise a metal sheet, a plastic sheet, or a ceramic or glass disc. The thickness of the thin film support layer 270 may be selected such that the thin film support layer 270 is strong enough to hold the self-solidifying material 230 in place when the self-solidifying material 230 is in the relatively soft state, while also having the ability to break or tear when lowering the fishing tool 200 over the fish, so as to allow the fish to pass through the thin film support layer 270 and become immersed within the self-solidifying material 230.

Figure 4:
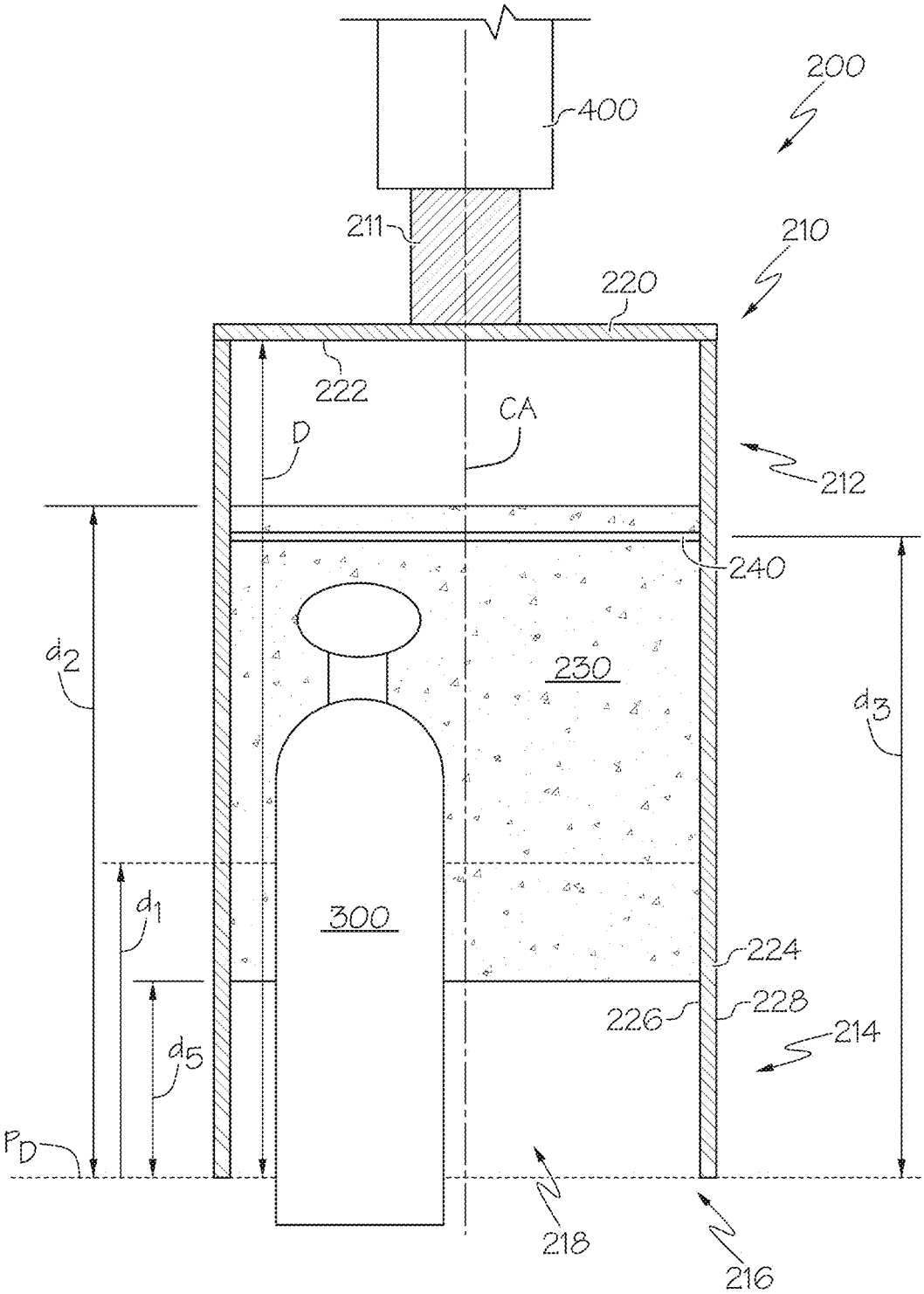
FIG. 4 schematically depicts in cross-section a fishing tool of the present disclosure after a fish has been immersed in the self-solidifying material disposed within the cavity of the housing, according to one or more embodiments described herein.

FIG. 4 depicts the embodiment of the fishing tool 200 shown in FIG. 1 after a fish 300 has been partially immersed in the self-solidifying material 230. As can be seen, immersion of the fish 300 in the self-solidifying material 230 may cause displacement of the self-solidifying material in the proximal direction towards the opening 216 of the fishing tool 200. As discussed above, in embodiments, the internal diameter ID, the depth D of the cavity 218, the first depth $d_1$, and the second depth $d_2$ are selected such the immersion of the at least a portion of the fish 300 within the self-solidifying material 230 does not cause displacement of the self-solidifying material 230 out of the cavity 218 of the housing 210. For example, FIG. 4 shows displacement of the self-solidifying material 230 in the proximal direction from the first depth $d_1$ to the displaced depth $d_s$, but not outside of the cavity 218 of the housing 210, i.e., not through the opening 216 of the housing 210.

In embodiments, the fishing tool 200 may be attached to the distal end of the conveyor 400 by attaching a bottom hole assembly (not shown) to the distal end of the conveyor 400 and then attaching the fishing tool 200 to the distal end of the bottom hole assembly. In other embodiments, as shown in FIG. 4, the fishing tool 200 may comprise a connector 211 coupled to the proximal end 212 of the housing 210 and configured to be attached to the distal end of the conveyor 400. The connector 211 may be coupled to the housing 210 via a bond such as a weld, a solder, a braze, or one or more fasteners such as screws, bolts, and rivets employed together or in combination. The connector 211 may include means for mechanical support, such as an API standard tool joint as specified in ISO 11961:2018, and ISO 10424-2 published by the International Organization for Standardization, or API Spec 7-2 published by the American Petroleum Institute, the contents of each of which is incorporated by reference herein in their entirety. The connector 211 may include means for telemetry connectivity, such as the wired drill pipe connector described in U.S. Pat. No. 8,791,832, entitled "Apparatus, system, and method for communicating while logging with wired drill pipe," the contents of which are incorporated by reference herein in their entirety.

Unless otherwise specified, a range of values, when recited, includes both the upper and lower limits of the range as well as any sub-ranges therebetween. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

As used herein, the indefinite articles "a," "an," and the corresponding definite article "the" mean "at least one" or "one or more," unless otherwise specified. It will also be understood that the various features disclosed in the specification and the drawings can be used in any and all combinations.

As used herein and in the appended claims, the words "comprise," "has," and "include" and all grammatical variations thereof are each intended to have an open, non-limiting meaning that does not exclude additional elements or steps.

Reference throughout this specification to "one embodiment," "embodiments," "certain embodiments," "some embodiments," "various embodiments," "one or more embodiments," or "an embodiment" means that a particular feature, structure, material, or characteristic described in connection with the embodiment is included in at least one embodiment of the disclosure. Thus, the appearances of the phrases such as "in embodiments," "in one or more embodiments," "in certain embodiments," "in various embodiments," "in one embodiment," "in some embodiments," or "in an embodiment" in various places throughout this specification are not necessarily referring to the same embodiment. Furthermore, the particular features, structures, materials, or characteristics described in connection with one embodiment may be combined in any suitable manner in one or more other embodiments.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

Having described the subject matter herein in detail and by reference to specific embodiments, it is noted that the various details disclosed herein should not be taken to imply that these details relate to elements that are essential components of the various embodiments described herein. Further, it will be apparent that modifications and variations are possible without departing from the scope herein, including, but not limited to, embodiments defined in the appended claims.

What is claimed is:

1. A method of removing a fish from a wellbore, the method comprising:

attaching a fishing tool to a distal end of a conveyor, the fishing tool comprising:

a housing comprising:

a proximal end configured to be attached to the distal end of the conveyor; and a distal end opposite the proximal end, the distal end comprising an opening that extends into a cavity of the housing; and a self-solidifying material disposed within the cavity of the housing and configured to transition from a relatively soft state to a relatively hard state;

inserting the fishing tool attached to the conveyor into the wellbore;

lowering the fishing tool over the fish in the wellbore to immerse at least a portion of the fish within the self-solidifying material;

allowing the self-solidifying material to transition from the relatively soft state to the relatively hard state, thereby securing the fish to the fishing tool; and retracting the fishing tool attached to the conveyor from the wellbore to remove the fish from the wellbore, wherein the fishing tool further comprises a thin film support layer configured to maintain the self-solidifying material within the cavity of the housing.

2. The method of claim 1, wherein attaching the fishing tool to the distal end of the conveyor comprises:

attaching a bottom hole assembly to the distal end of the conveyor; and attaching the fishing tool to a distal end of the bottom hole assembly.

3. The method of claim 1, wherein the fishing tool further comprises a connector coupled to the proximal end of the housing, and wherein attaching the fishing tool to the distal end of the conveyor comprises attaching the connector to the distal end of the conveyor.

4. The method of claim 1, wherein the self-solidifying material fills the cavity of the housing between a first depth $d_1$ and a second depth $d_2$, wherein the second depth $d_2$ is more proximal than the first depth $d_1$.

5. The method of claim 4, wherein the fishing tool further comprises a plurality of pins traversing the cavity of the housing at an intermediate depth $d_3$, wherein the intermediate depth $d_3$ is more proximal than the first depth $d_1$ but more distal than the second depth $d_2$, and wherein the plurality of pins are configured to secure the self-solidifying material within the cavity of the housing.

6. The method of claim 4, wherein the fishing tool further comprises a plurality of spikes configured to secure the self-solidifying material within the cavity of the housing.

7. The method of claim 6, wherein:

the housing further comprises:

a central axis CA;

an end wall positioned at the proximal end of the housing; and a sidewall extending coaxially with the central axis CA from a perimeter of the end wall to a distal end plane of the housing; and each spike of the plurality of spikes:

extends inward from an interior surface of the sidewall at an intermediate depth $d_3$ more proximal than the first depth $d_1$ but more distal than the second depth $d_2$; and forms an angle $\alpha$ with respect to the sidewall, the angle $\alpha$ being greater than or equal to 10 degrees and less than or equal to 90 degrees.

8. The method of claim 6, wherein:

the housing further comprises:

a central axis CA;

an end wall positioned at the proximal end of the housing; and a sidewall extending coaxially with the central axis CA from a perimeter of the end wall to a distal end plane of the housing;

the plurality of spikes comprises a first set of spikes and a second set of spikes;

each spike of the first set of spikes:

extends inward from an interior surface of the sidewall at a first intermediate depth $d_3$ more proximal than the first depth $d_1$ but more distal than the second depth $d_2$; and forms an angle $\alpha$ with respect to the sidewall, the angle $\alpha$ being less than 90 degrees; and each spike of the second set of spikes:

extends inward from the interior surface of the sidewall at a second intermediate depth $d_4$ more proximal than the first depth $d_1$ but more distal than the first intermediate depth $d_3$; and forms the angle $\alpha$ with respect to the sidewall.

9. The method of claim 4, wherein:

the housing further comprises:

a central axis CA;

an end wall positioned at the proximal end of the housing; and a sidewall extending coaxially with the central axis CA from a perimeter of the end wall to a distal end plane of the housing;

the cavity of the housing is defined by an interior surface of the end wall, an interior surface of the sidewall, and the distal end plane of the housing;

the cavity comprises:

an internal diameter ID; and a depth D defined as the distance along the central axis CA between the interior surface of the end wall and the distal end plane of the housing; and the internal diameter ID, the depth D of the cavity, the first depth $d_1$, and the second depth $d_2$ are selected such the immersion of the at least the portion of the fish within the self-solidifying material does not cause displacement of the self-solidifying material out of the cavity of the housing.

10. The method of claim 1, wherein the self-solidifying material comprises a cement.

11. The method of claim 1, wherein the self-solidifying material comprises a nano-silica based material.

12. The method of claim 1, wherein the self-solidifying material comprises a time and/or temperature activated gel or foam.

13. The method of claim 1, wherein the self-solidifying material comprises a polymerizable resin.

14. The method of claim 1, wherein the self-solidifying material has a setting time greater than or equal to 2 hours and less than or equal to 12 hours.

15. The method of claim 1, wherein the self-solidifying material, in the relatively soft state, has a viscosity greater than or equal to one centipoise (cP) and less than or equal to 500,000 cP.

16. The method of claim 1, wherein the self-solidifying material, in the relatively hard state, has a tensile strength of greater than or equal to one megapascal (MPa) and less than or equal to 2,900 MPa.

17. The method of claim 1, wherein:

the self-solidifying material, in the relatively soft state, has a viscosity greater than or equal to one centipoise (cP) and less than or equal to 500,000 cP; and the self-solidifying material, in the relatively hard state, has a tensile strength of greater than or equal to one megapascal (MPa) and less than or equal to 2,900 MPa.

18. The method of claim 17, wherein the self-solidifying material has a setting time greater than or equal to 2 hours and less than or equal to 12 hours.

19. The method of claim 1, wherein the self-solidifying material is disposed within an insert that is secured within the cavity of the housing.

* * * * *